US009206028B2

(12) United States Patent
Hanssen

(10) Patent No.: US 9,206,028 B2
(45) Date of Patent: Dec. 8, 2015

(54) DISPENSE HEAD

(75) Inventor: Hubert Joseph Frans Hanssen, Amsterdam (NL)

(73) Assignee: Eurokeg B.V., Den Helder (NL)

( * ) Notice: Subject to any disclaimer, the term of this patent is extended or adjusted under 35 U.S.C. 154(b) by 649 days.

(21) Appl. No.: 12/668,122

(22) PCT Filed: Jul. 1, 2008

(86) PCT No.: PCT/EP2008/058425
§ 371 (c)(1),
(2), (4) Date: Mar. 22, 2010

(87) PCT Pub. No.: WO2009/007270
PCT Pub. Date: Jan. 15, 2009

(65) Prior Publication Data

US 2010/0181346 A1 Jul. 22, 2010

(30) Foreign Application Priority Data

Jul. 10, 2007 (EP) ..... 07112187

(51) Int. Cl.

| | |
|---|---|
| ***B65D 83/00*** | (2006.01) |
| ***B67D 1/08*** | (2006.01) |
| *B67D 7/02* | (2010.01) |
| *B65D 83/30* | (2006.01) |

(52) U.S. Cl.
CPC ..... *B67D 1/0831* (2013.01); *B65D 83/303* (2013.01); *B65D 2231/004* (2013.01); *B67D 7/0294* (2013.01)

(58) Field of Classification Search
CPC .. B67D 1/0829; B67D 1/0412; B67D 1/0832; B67D 1/0835; B67D 1/08; B67D 1/0831; B67D 7/0288; B67D 7/0294; B65D 2231/004; B65D 83/303
USPC ..... 222/400.7, 394, 399, 464.1; 137/212, 137/317, 318, 322, 209
See application file for complete search history.

(56) References Cited

U.S. PATENT DOCUMENTS

| | | | | |
|---|---|---|---|---|
| 3,353,724 | A * | 11/1967 | Johnston | 222/400.7 |
| 3,422,448 | A * | 1/1969 | Johnston | 222/400.7 |
| 3,435,997 | A * | 4/1969 | Johnston | 222/400.7 |
| 3,438,553 | A * | 4/1969 | Johnston | 222/400.7 |

(Continued)

FOREIGN PATENT DOCUMENTS

| | | |
|---|---|---|
| DE | 1301263 B | 8/1969 |
| EP | 0626338 | 5/1994 |

(Continued)

OTHER PUBLICATIONS

Written Opinion of the European Patent Office in counterpart foreign application No. PCT/EP2008/058425 filed Jul. 1, 2008.
Official Search Report of the European Patent Office in counterpart foreign application No. PCT/EP2008/058425 filed Jul. 1, 2008.
Office Action of the European Patent Office in counterpart foreign application No. EP 07112187.5 filed Jul. 10, 2007, dated Feb. 28, 2012.

(Continued)

*Primary Examiner* — Frederick C Nicolas
*Assistant Examiner* — Bob Zadeh
(74) *Attorney, Agent, or Firm* — Steven M. Koehler; Westman, Champlin & Koehler, P.A.

(57) ABSTRACT

A dispense head to be connected to a valve of a container for fluids, in particular liquids, such as beer or water. The dispense head comprises a housing and a probe. The distal end of the probe is detached or detachable from the rest of the probe and/or the housing and the distal end is connected or connectable to a flexible hose.

19 Claims, 2 Drawing Sheets

(56) References Cited

U.S. PATENT DOCUMENTS

| | | | | |
|---|---|---|---|---|
| 3,439,844 | A * | 4/1969 | Johnston | 222/398 |
| 3,490,483 | A * | 1/1970 | Nicko | 137/212 |
| 3,591,058 | A * | 7/1971 | Johnston | 222/400.7 |
| 3,599,843 | A * | 8/1971 | Johnston | 222/399 |
| 3,637,117 | A * | 1/1972 | Johnston | 222/400.7 |
| 3,743,145 | A * | 7/1973 | Johnston | 222/400.7 |
| 4,212,414 | A * | 7/1980 | Beyens | 222/148 |
| 5,617,977 | A * | 4/1997 | Augustinus | 222/400.7 |
| 6,669,051 | B1 * | 12/2003 | Phallen et al. | 222/1 |
| 6,745,922 | B1 * | 6/2004 | Vlooswijk et al. | 222/399 |
| 7,032,781 | B2 | 4/2006 | van der Klaauw | |
| 7,661,556 | B2 * | 2/2010 | van der Klaauw et al. | 222/1 |
| 2004/0011828 | A1 * | 1/2004 | Van Der Klaauw et al. | 222/527 |
| 2004/0134939 | A1 | 7/2004 | van der Klaauw | |
| 2004/0226967 | A1 * | 11/2004 | Van Der Klaauw et al. | 222/146.6 |
| 2006/0180605 | A1 * | 8/2006 | Priebe et al. | 222/1 |
| 2009/0184133 | A1 * | 7/2009 | Hasegawa et al. | 222/95 |
| 2011/0232778 | A1 * | 9/2011 | Van Der Klaauw et al. | 137/320 |

FOREIGN PATENT DOCUMENTS

| | | | |
|---|---|---|---|
| WO | WO 00/07902 | | 2/2000 |
| WO | WO 02079075 | A | 10/2000 |
| WO | WO 0107331 | A | 10/2002 |

OTHER PUBLICATIONS

State Intellectual Property Office of The People's Republic of China, Notification of the Second Office Action, Date of Notification Mar. 25, 2013.

State Intellectual Property Office of The People's Republic of China, Notification of the Third Office Action, Date of Notification Nov. 15, 2013.

Substantive/Examination Adverse Report (Section 30(1) / 30(2) from Intellectual Property Corporation of Malaysia, dated May 15, 2014 and Substantive/Examination Examiners Report to The Register Under Section 30(1) / 30(2) from Intellectual Property Corporation of Malaysia, dated Mar. 28, 2014 for corresponding application No. PI2010000043.

State Intellectual Property Office of The People's Republic of China for corresponding Chinese Application Serial No. 200880023597.4, date of notification May 13, 2014, Rejection Decision.

Official Notification received Jul. 2, 2014 for corresponding foreign Israeli Application No. 202787.

Communication pursuant to Article 94(3) EPC for corresponding foreign application EP2014608, published Jan. 14, 2009, mail date Mar. 26, 2015.

* cited by examiner

DISPENSE HEAD

CROSS-REFERENCE TO RELATED APPLICATION

The present application is a national stage filing of International patent application Serial No. PCT/EP2008/058425, filed Jul. 1, 2008, and published as WO 2009/007270 in English.

BACKGROUND

The discussion below is merely provided for general background information and is not intended to be used as an aid in determining the scope of the claimed subject matter.

Aspects of the invention relate to a dispense head, also referred to as a coupler, to be connected to a valve of a container for fluids, in particular liquids, such as beer or water, which dispense head comprises a housing and a probe. The invention also relates to a kit comprising a container.

US 2004/226967 discloses a drink dispenser assembly (denoted by numerals "1" and "25" in the figures of US 2004/226967) comprising a dispenser device provided with a tap (erroneously referred to as "dispensing head") for accommodating a flexible plastic dispensing line, and a container containing drink, in particular carbonated drink, connected during use to the dispensing line which has a coupling element at an outlet end for connection to the tap. The dispensing line can be permanently connected to the container containing carbonated drink, but can also be provided with a coupling for detachable connection to the container. An aim of the invention disclosed in US 2004/226967 is to provide a drink dispenser assembly that requires very little maintenance, requires little cleaning and provides a hygienic environment with a relatively long life for the drink.

Flexible hoses are a well known alternative to frequently cleaning dispensing lines.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

A dispense head according to an aspect of the present invention is characterized in that the distal end of the probe is detached or detachable from the rest of the probe and/or the housing and the distal end is connected or connectable to a flexible hose.

Thus, after the hose has been fitted in the dispensing line of a dispensing system and the distal end has been attached to the probe and/or the housing, the dispense head can be coupled to a container in at least substantially the same way as existing dispense heads.

An aspect of the invention also relates to a kit comprising a container for fluids, in particular liquids, such as beer or water, having a valve to be connected to a dispense head, an element to be fitted to a distal end of the (incomplete) probe of a dispense head, and a flexible hose connected or connectable to the element.

BRIEF DESCRIPTION OF THE DRAWINGS

Aspects of the invention will now be explained in more detail with reference to the figures, which show an embodiment of the dispense head.

DETAILED DESCRIPTION OF THE ILLUSTRATIVE EMBODIMENTS

Figure 1:
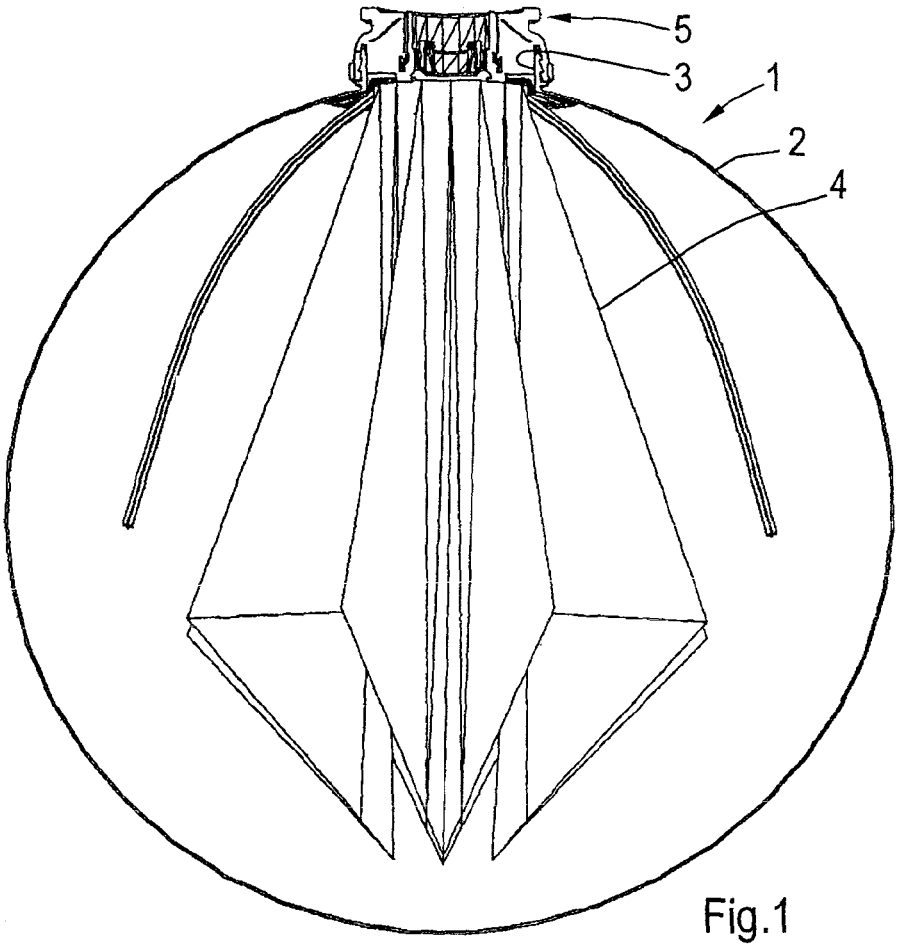
FIG. 1 is a cross-section of a container for fluids.

The drawings are not necessarily to scale and details, which are not necessary for understanding the present invention, may have been omitted. Further, elements that are at least substantially identical or that perform an at least substantially identical function are denoted by the same numeral. Furthermore, terms such as "upper", "lower", and the like relate to the orientation of elements as shown in the drawings.

FIG. 1 shows a container 1 for fluids, in particular liquids, such as beer or soft drinks under pressure, comprising a spherical and pressure resistant outer casing 2 having a central opening 3, a gastight inner casing 4 of a flexible material, i.e. a bag, located inside the outer casing 2, and a valve part 5, located in the central opening 3, for filling the container 1, more specifically the inner casing 4, with a liquid respectively withdrawing liquid from the container 1.

In this example, the outer casing 2 was made by blow-molding a polyester preform, in particular a PET (polyethylene terephthalate) or PEN (polyethylene naphthalate) preform. The upper rim 7 (FIG. 2) of the preform and (hence) of the opening 3 in the outer casing 2, comprises a collar 8 for holding the preform during blow-molding in a manner known in itself and, above the collar 8, one or more, in this example two, annular and upwardly tapering ledges 9 for establishing a snap-fit connection with the valve part 5, as will be explained in more detail below.

Alternatively, the outer casing may be made of e.g. a relatively thick-walled thermoplastic material or even a metal, such as aluminum. As another example, the outer casing may be collapsible and made from a blow-molded thermoplastic e.g. PE or a elastomeric liner provided with a filament wound outer reinforcement and an outer layer of latex obtained by immersing the liner (with filaments) in a latex bath. Yet other suitable casings are described in, for example, EP 0 626 338, which is incorporated herein by reference.

Figure 2:
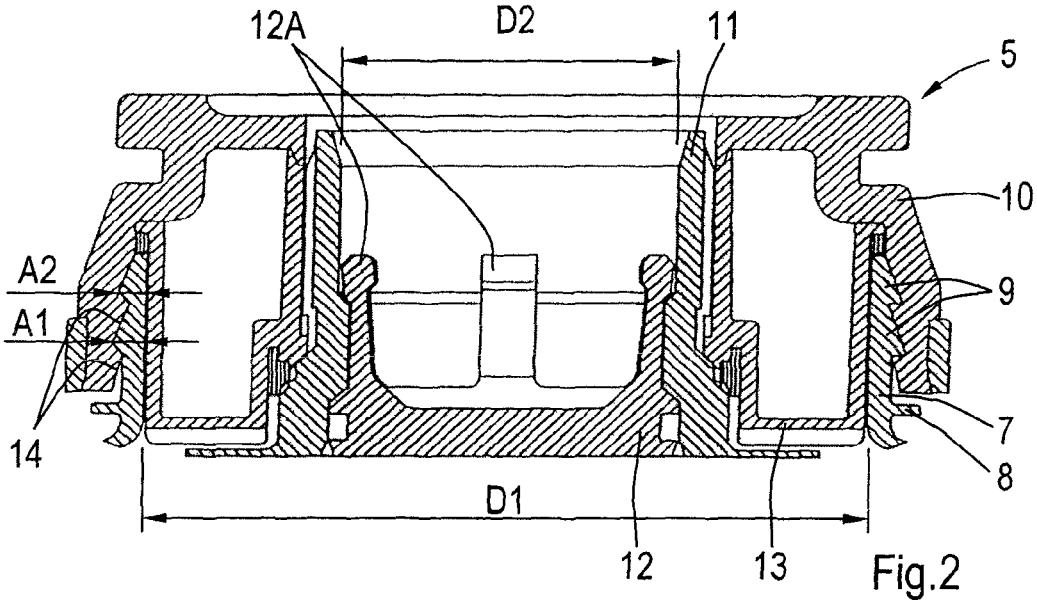
FIG. 2 is a cross-section of the valve part of the container in FIG. 1.

As shown in FIG. 2, the valve part 5 comprises an outer jacket 10, made, in this example, of glass fiber reinforced PP, an inner jacket 11 slidably received inside the outer jacket 10, and a closing element 12 which, in turn, is slidably received inside the inner jacket 11, and which comprises a plurality of resilient fingers 12A. The inner jacket 11 and the closing element are both made of a polyolefin such as PE or PP. A preferred valve part of this type is also disclosed in International patent application WO 00/07902 (see especially page 8, line 12 ff. in conjunction with FIGS. 4A and 4B), which is incorporated herein by reference.

Figure 3A:
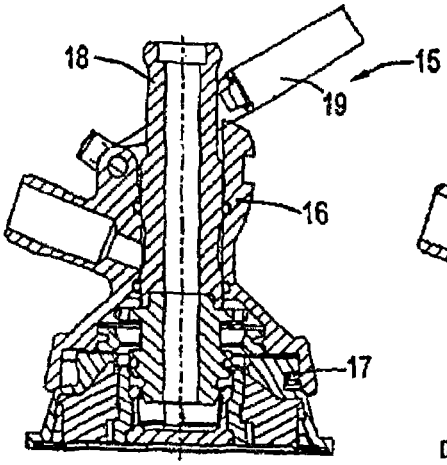
Fig.3A Prior Art
FIGS. 3A and 3B are cross-sections of a dispense head according to the prior art, just prior to and after broaching of the container, respectively.
Figure 3B:
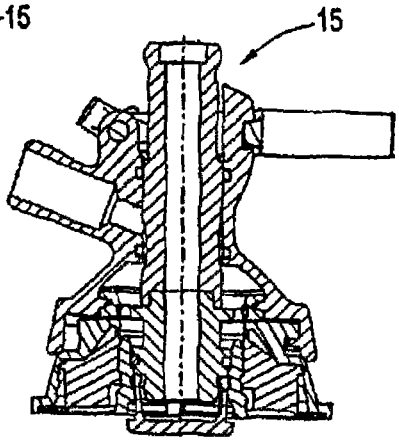
Fig.3B Prior Art

When, as shown in FIGS. 3A and 3B, a probe of a dispense head is pushed into the valve part 5, the inner jacket 11 slides with respect to the outer jacket 10 providing one or more vents for letting in pressurized gas to expel liquid from the inner casing 4. Further, the closing element 12 slides with respect to the inner jacket 11 providing an opening for letting the liquid out. The outer jacket 10 comprises, in its bottom surface and preferably on a separate element to facilitate manufacture, a plurality of radially extending channels or, in this case, venting grooves 13.

The inner wall of the outer jacket 10 comprises one or more, in this example two, annular and downwardly tapering counter-ledges 14 (FIG. 2). Thus, the valve part 5 can be snap-fitted substantially irreversibly to the outer casing 2 by holding the outer casing 2 in position, e.g. by means of two semi-circular rings below the collar 8, placing the outer jacket 10, preferably after heating it to 60° C.-80° C., over the upper rim 7, pushing the valve part 5 downwards until the counter-ledges 14 snap-fit over ledges 9 on the rim 7 of the outer casing, and allowing the valve part 5 to cool.

The inner casing 4 comprises two, in this example polygonal, flexible sheets of a gas and liquid tight laminate, preferably a laminate comprising a sealing layer (e.g., PE or PP), a barrier layer (e.g. aluminum) and one or more further layers (e.g. PA and/or PET), sealed together along their edges, e.g. by means of welding. As shown in FIG. 1, the inner casing 4 comprises an opening the perimeter of which has been welded to a flange on the inner jacket of the valve part 5.

FIGS. 3A and 3B show a dispense head 15 according to the prior art, comprising a housing 16, which can be coupled to the valve 5 by means of a bayonet fitting 17, a probe 18 consisting of two metal parts irreversibly press-fitted and glued together and slidably accommodated inside the housing 16, and a handle 19 for sliding the probe 18 inside the housing 16 just prior to broaching (FIG. 3A) and after broaching (FIG. 3B).

Figure 4:
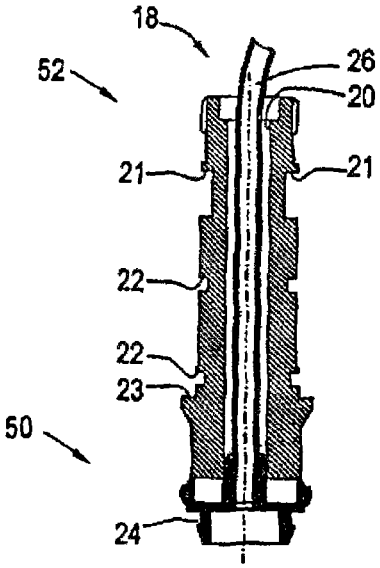
FIG. 4 is a cross-section of a probe.
Figure 5:
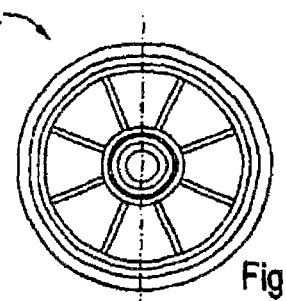
FIGS. 5 and 6 are a top view and a cross-section of the distal end of the probe shown in FIG. 4.

FIG. 4 shows a probe 18 according to an aspect of the present invention, which can be fitted in a dispense head as shown in FIGS. 3A and 3B. The probe 18 comprises a through-bore 20 and, from the top down, tangential notches 21 for receiving two sides of the handle 19, annular notches 22 about the circumference of the probe 18 for accommodating O-rings, and a stop 23 to define the axial position of the probe 18 relative to the housing 16 in the uncoupled position.

Figure 6:
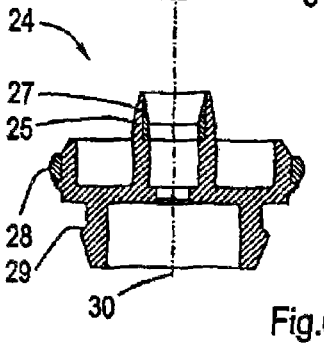

The distal end 50 of the probe 18, i.e. the end facing away from a person operating the dispense head 15 and, once connected to a container, facing towards the container 1, further comprises an element 24 that is detachable from the rest of the probe 18. To this end, the shown embodiment of the distal end element 24 is made of a polymer, such as PE or PP, and comprises a circle-cylindrical central joint 25 (see also FIG. 6) having an outer diameter that slightly exceeds, e.g. by 5%, the inner diameter of the through-bore 20, thus enabling the distal end element 24 to be clamped to the rest of the probe 18. A proximal end 52 of the probe 18 is opposite the distal end 50.

Other suitable ways of attaching this distal end element (24) to the rest of the probe include, but are not limited to, screw-threads on both the element and the probe, and reversibly snap-fitting the element to the probe, e.g. by means of an annular notch or a protruding annular rim on the element or two or more resilient fingers on one part and corresponding recesses on the other part.

A flexible hose 26, made e.g. of a polyolefin, such as PE or LDPE, and having an outer diameter of e.g. 6 mm, is connected to the distal end element 24, in this example by clamping one end of the hose 26 in said joint 25. To this end, the outer diameter of the end of the hose 26 exceeds the inner diameter of the joint 25. To further enhance the airtightness of the seal between the hose 26 and the distal end element 24, the joint 25 is provided, along its inner wall with an elastomeric ring 27. Alternatively, the distal end element 24 and the hose 26 form an integral whole or are irreversibly connected, e.g., by means of welding or gluing.

The distal end element 24 further comprises a seal, e.g. an elastomeric ring 28 along its circumference, which, upon coupling the dispense head 15 to a container 1, seals the dispense head 15 from the fluid in the container 1. Thus, neither the dispensing line of the system not any of the reusable parts of the dispense head come into contact with the fluid dispensed from the container or, put differently, all parts that, during dispensing, come into contact are disposable or can be cleaned separately. The distal end and the seal can be made e.g. by two component injection molding.

To prevent the hose 26 from being used more than once, the distal end element 24 can be designed such that, upon coupling the dispense head 15 to a container 1, the connection established between the distal end element 24 of the probe 18 and the container 1 is stronger than the connection between the distal end element 24 of the probe 18 and the rest of the probe. If, in that case, the dispense head 15 is removed from the container 1, the distal end becomes detached from the rest of the probe and stays behind on the container 1, along with the flexible hose 26. Connections of this kind can be obtained by changing the geometry of the distal part, e.g. by increasing the angle (relative to the central axis 30 of the distal end element 24) of the locking surface 29 on the distal end element 24 or by increasing the diameter of the distal end element 24 where it interacts with the fingers 12A of the closing element 12.

The invention is not restricted to the above-described embodiments which can be varied in a number of ways within the scope of the claims. For instance, although the invention has been illustrated by reference to a particular type of dispense head, i.e. one for use with a so-called LWC type keg fitting as shown in FIGS. 2, 3, and 4, the invention is also suitable for use with other generally available dispense heads, such as dispense heads for European or American Sankey type keg fitting, German slider keg fitting or Grundy type keg fitting, also referred to as S, D, A or G type interface, respectively.

The invention claimed is:

1. A dispense head to be connected to a valve of a container for fluids, the dispense head comprising a housing and a probe with a bore extending therethrough to a distal end, wherein the distal end of the probe includes a distal end element detachable from a rest of the probe and the distal end element is connected to a flexible hose disposed at least partially within the bore and configured to prevent fluid from contacting a surface of the bore during dispensing, wherein the distal end element is an end of the probe facing away from a person operating the dispense head and, once connected to the container, facing towards the container and is configured to engage the valve of the container to pass fluid to the flexible hose.

2. The dispense head according to claim 1, wherein the distal end element is attachable to the rest of the probe by clamping, screwing or snap-fitting.

3. The dispense head according to claim 1, wherein the distal end element is configured to be coupleable to the container and to the rest of the probe, wherein, upon coupling the dispense head to the container, a connection established between the distal end element and the container is stronger than a connection between the distal end element and the rest of the probe.

4. The dispense head according to claim 1, wherein the distal end element comprises a seal configured to seal the dispense head from the fluid in the container upon coupling the dispense head to the container.

5. The dispense head according to claim 1, wherein the distal end element and the flexible hose form an integral whole or are irreversibly connected.

6. The dispense head according to claim 1, wherein the distal end element comprises a hose joint for friction fitting the flexible hose to the distal end element.

7. The dispense head according to claim 1, wherein the distal end element is made of a polymer material.

8. A kit comprising:

a container for a fluid, having a valve, a dispense head connectable to the valve, the dispense head comprising a housing having an aperture, a probe disposed in the aperture, the probe including a bore extending therethrough to an end of the probe, an element configured to be detachably joined to the end of the probe, wherein the element is disposed on the end of the probe facing away from a person operating the dispense head and, once connected to the container, facing towards the container, and wherein the element is configured to engage the valve of the container to pass fluid from the container to the flexible hose, a flexible hose connected or connectable to the element when disposed at least partially within the bore and configured to prevent fluid from contacting a surface of the bore during dispensing.

9. The kit according to claim 8, wherein the element is attachable to the probe by clamping, screwing or snap-fitting.

10. The kit according to claim 8, wherein, upon coupling the dispense head to the container, the element is configured to provide a stronger connection between the element and the container than a connection between the element and the probe.

11. The kit according to claim 8, wherein the element comprises a seal configured to seal the dispense head from the fluid in the container upon coupling the dispense head to the container.

12. The kit according to claim 8, wherein the element and the flexible hose form an integral whole or are irreversibly connected.

13. The kit according to claim 8, wherein the element comprises a hose joint for friction fitting the flexible hose to the element.

14. A kit comprising:

a dispense head connectable to a valve of a container for a fluid, the dispense head comprising a housing having an aperture, a probe disposed in the aperture, the probe having a proximal end, a distal end, and a bore formed through at least a portion of the probe between the proximal end and the distal end, an element configured to be detachably joined to the distal end of the probe, and a flexible hose connected or connectable to the element such that when at least a portion of the flexible hose is positioned in the bore the flexible hose is configured to prevent fluid from contacting a surface of the bore during dispensing, wherein when the element is connected to the valve the element is disposed between the valve and the distal end of the probe facing away from a person operating the dispense head and, once connected to a container, facing the container, and the element has an aperture in fluid communication with the flexible hose to pass fluid from the container to the flexible hose.

15. The kit according to claim 14, wherein the element is attachable to the probe by clamping, screwing or snap-fitting.

16. The kit according to claim 14, wherein, upon coupling the dispense head to the container, the element is configured to provide a stronger connection between the element and the container than a connection between the element and the probe.

17. The kit according to claim 14, wherein the element comprises a seal configured to seal the dispense head from the fluid in the container upon coupling the dispense head to the container.

18. The kit according to claim 14, wherein the element and the flexible hose form an integral whole or are irreversibly connected.

19. The kit according to claim 14, wherein the element comprises a hose joint for friction fitting the flexible hose to the element.

* * * * *